United States Patent [19]

Ditton et al.

[11] Patent Number: 4,471,920

[45] Date of Patent: Sep. 18, 1984

[54] TAPERED FLANGE WIRE SPOOL

[75] Inventors: Louis G. Ditton, Fort Wayne, Ind.; Alvin D. Thomas, Valatie, N.Y.

[73] Assignee: Essex Group, Inc., Fort Wayne, Ind.

[21] Appl. No.: 465,071

[22] Filed: Feb. 9, 1983

[51] Int. Cl.[3] ..... B65H 75/14

[52] U.S. Cl. ..... 242/118.61; 242/118.7

[58] Field of Search ..... 242/115, 118, 118.6, 242/118.8, 125, 125.1, 77, 77.3, 77.4, 71.8

[56] References Cited

U.S. PATENT DOCUMENTS

| | | | |
|---|---|---|---|
| 3,334,841 | 8/1967 | Burhop | 242/118.61 |
| 3,717,315 | 2/1973 | Kovaleski | 242/115 |
| 3,822,841 | 7/1974 | Campbell | 242/115 |
| 3,948,458 | 4/1976 | Beck et al. | 242/118.7 |
| 4,066,225 | 1/1978 | Bauer | 242/118.8 |

FOREIGN PATENT DOCUMENTS

| | | | |
|---|---|---|---|
| 761061 | 9/1980 | U.S.S.R. | 242/118.4 |

*Primary Examiner*—Leonard D. Christian

*Attorney, Agent, or Firm*—Robert D. Sommer

[57] ABSTRACT

A tapered flange wire spool construction having a load supporting hub portion at each end of a spool with a load bearing surface lying outwardly of the outer end surface of a respective outwardly flared end flange portion of the spool to enable the weight of wire carried by the spool to be transferred solely through a hub portion to a supportive surface disposed below the spool for preventing impact of the corresponding end flange portion with the supportive surface.

2 Claims, 4 Drawing Figures

TAPERED FLANGE WIRE SPOOL

BACKGROUND OF THE INVENTION

This invention relates to spools for wire, and more particularly to tapered flange wire spools having outwardly flared end flanges at opposite ends of a barrel.

Tapered flange wire spools now in general use are commonly made from synthetic plastic resins because of their relatively low weight and cost. Such plastic spools loaded with wire are ordinarily shipped in cartons with the longitudinal axis of the spools disposed vertically. Because a substantial weight of wire usually in excess of ten kilograms is carried by each spool, the lower weight supporting end flanges of the spools tend to break, crack, or split when subject to shock and impact forces during shipment. The upper end flanges are likewise subject to damage when the spools are disposed beneath other objects such as additional spool containing cartons. As shown in U.S. Pat. No. 3,717,315, tapered flange wire spools can be made more rugged by employing a relatively thick-wall construction of fiberglass and polyester resin materials and reinforcing the peripheral bead portion of each end flange with a wire ring insert. Although this spool construction is more resistant to damage, its cost is greater than that of an unreinforced thin-wall spool construction.

In plastic spools having generally planar end flanges normal to the spool axis, it is known to provide each end flange with an axially outwardly extending annular rim at its outer periphery joined to the outer surface of the end flange by radial ribs. Examples of this type of end flange construction are disclosed in U.S. Pat. Nos. 3,822,841 and 3,948,458. It is evident that the incorporation of this type of flange construction in tapered flange spools would increase the complexity and cost of the spools with only a minimum improvement in resistance to shock and impact forces.

SUMMARY OF THE INVENTION

The present invention provides an improved light weight spool for metal wire which has a tubular barrel portion with hub portions and outwardly flared thin-wall end flange portions at each end. Each end flange portion comprises a frustro-conical body of substantially uniform thickness with an enlarged peripheral rim portion at its outer larger end which has a circumferential outer end surface substantially tangent to a plane normal to the spool axis. Each hub portion comprises a cup-shaped body extending axially within a corresponding one of the end flange portions and having a generally tubular load transfer side wall joined at its inner end to the barrel portion and spanned at its outer end by a tranverse end wall presenting an outer load bearing surface normal to the spool axis. This load bearing surface lies outwardly of the plane of the outer end surface of the corresponding end flange portion an appreciable distance to enable the weight of wire carried by the spool to be transferred solely through the hub portion to a supportive surface disposed below the spool for preventing impact of the end flange portion with the supportive surface during shipment of the spool.

In accordance with a preferred embodiment of the invention, the end wall of each hub portion is provided with an inwardly extending cylindrical bushing at its center which is joined to the end wall and side wall of the hub portion by circumferentially spaced radial webs. In addition, the side wall of each hub portion may have a plurality of circumferentially spaced slots therein each communicating with a respective notch in the outer peripheral ends of the associated end wall to define hand hole openings so that each hub portion may be manually gripped by fingers extended through the opening for the purpose of lifting the spool.

For a better understanding of the invention, reference may be had to the following detailed description taken in connection with the accompanying drawings, in which:

DETAILED DESCRIPTION

Figure 1:
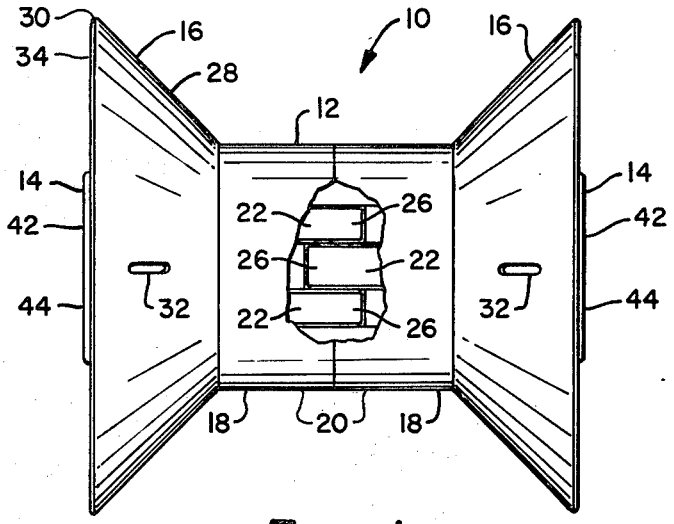
FIG. 1 is a side elevational view, partially broken away, of a spool embodying the invention.
Figure 2:
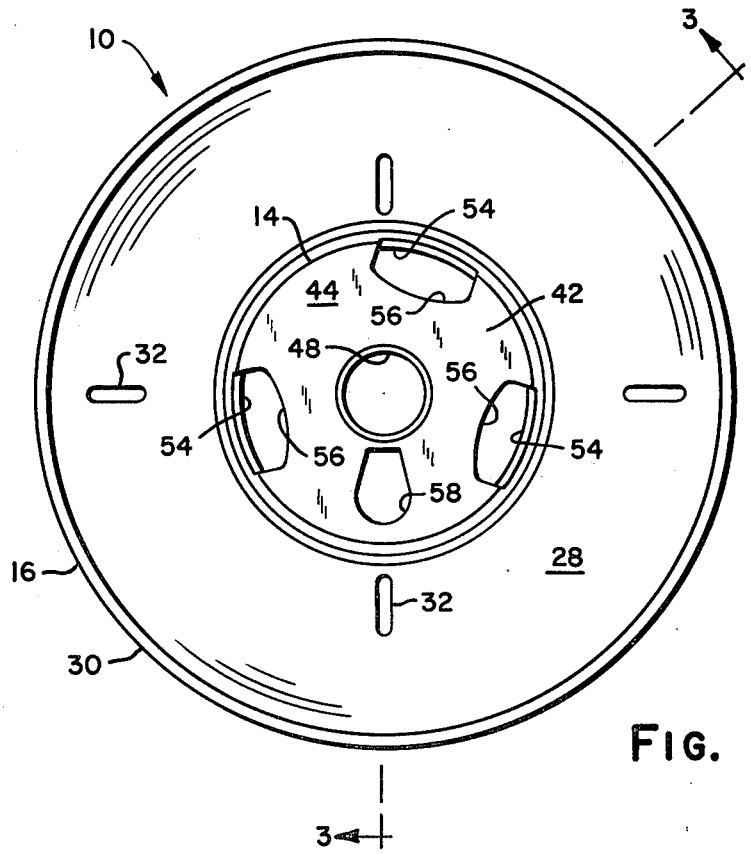
FIG. 2 is an end elevational view of the spool.
Figure 3:
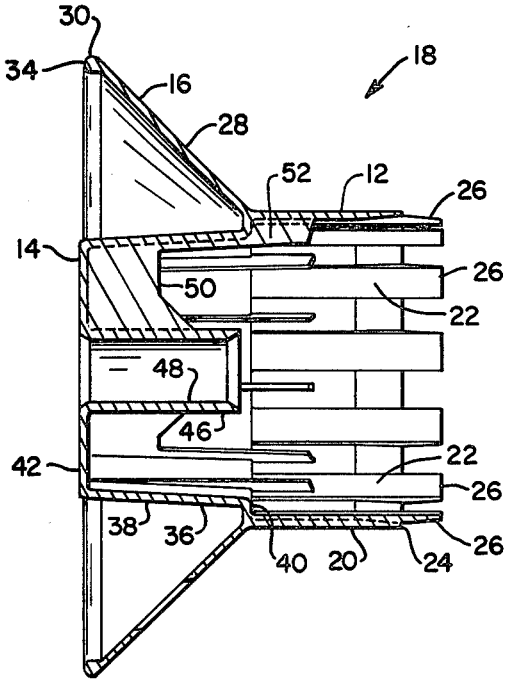
FIG. 3 is a cross-sectional view of one of two halves of the spool taken along the line 3—3 of FIG. 2.
Figure 4:
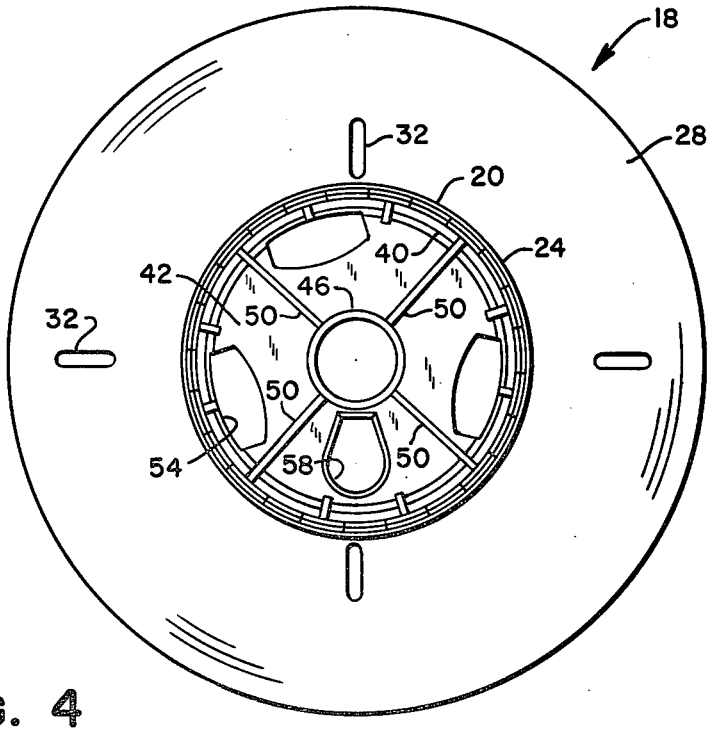
FIG. 4 is an end elevational view looking at the inner end of one spool half.

Referring to the drawing, a spool 10 according to the present invention comprises a tubular barrel portion 12, a pair of hub portions 14 each joined to a respective outer end of the barrel portion 12, and a pair of tapered or outwardly flared end flange portions 16 each joined to a respective outer end of the barrel portion 12. The spool 10 preferably consists of two identical halves 18 which are joined together. The spool halves 18 can be readily and economically molded from suitable synthetic resins such as polystyrene or polyethylene in various sizes for assembly in light weight storage spools suitable for the shipping, storage and handling of substantial weights of metal wire.

Each spool half 18 includes a generally cylindrical barrel wall 20 having longitudinally extending raised bosses 22 circumferentially spaced about the inner surface thereof. These bosses 22 extend beyond the open end 24 of the barrel wall 20 to form a corresponding number of tongues 26 which are shaped to fit in the spaces or grooves between the raised bosses 22 of another spool half 18 when two spool halves 18 are assembled together. The barrel walls 20 of two assembled spool halves may be joined to each other by bonding each of the tongues 26 of the other. Reference may be had to U.S. Pat. No. 3,334,841 for a more complete description of such an interfitted connection of spool halves.

The end flange portion 16 of each spool half 18 comprises a thin-wall frustro-conical body 28 of substantially uniform thickness and an enlarged peripheral rim 30 at the outer larger end of the body 28. The body 28 which may be provided with a few elongated inspection openings 32 has a thickness on the order of about two millimeters. The rim 30 is formed with a generally rounded profile of a width about twice the thickness of the body 28 and is not reinforced with a wire ring insert or the like. The circumferential outer end surface 34 of the rim 30 is substantially tangent to a plane normal to the axis of the spool 10.

The hub portion 14 of each spool half 18 comprises a cup-shaped body 36 extending axially within the associated end flange portion 16. A generally tubular load transfer side wall 38 of the body 36 is joined at its inner end to the outer end of the barrel wall 20 by an annular wall 40. The outer end of the side wall 38 is spanned by a tranverse end wall 42 presenting an outer load bearing surface 44 which is normal to the axis of the spool 10 and lies outwardly of the plane of the end surface 34 of the rim 30 an appreciable distance such as one millimeter. A cylindrical bushing 46 extends inwardly from the center of the end wall 42 and has an inner cylindrical bearing surface 48. A number of circumferentially spaced radial webs 50 interconnect the bushing 46, the end wall 40 and the side wall 38 to join these parts together. The side wall 38 may be reinforced by integral strengthening ribs 52 extending longitudinally from the webs 50 along the inner surface of the side wall 38 to the inner surface of the barrel wall 20. The side wall 38 is further provided with circumferentially spaced slots 54 which communicate with respective notches 56 in the outer peripheral edge of the end wall 42 to define hand hole openings so that the hub portion 14 may be manually gripped by fingers extended through the openings for the purpose of lifting the spool 10. The end wall 42 may also be provided with an off center drive hole 58 to receive drive means of spool winding or unwinding apparatus.

The tapered flange spool 10 of the present invention can be filled with wire by conventional winding apparatus. After being filled with wire, one or more of the spools 10 may be placed in a shipping carton with the longitudinal axis of each spool disposed vertically. Because of the longitudinal spacing between the end surface 44 of the hub portion 14 and the end surface 34 of the associated end flange portion 16, the weight of wire carried by spool 10 is transferred solely through the lower hub portion 14 to the supportive surface of the carton disposed below the spool. Thus when the spool 10 is subjected to shock or impact forces, there is no engagement between the supportive surface and the lower end flange portion 16 which could damage the end flange portion. It will also be evident that when the spool 10 is disposed beneath another object, the upper hub portion 14 of the spool intercepts any shock or impact forces applied by the object to the upper wall of the spool shipping carton, thus protecting the upper end flange portion 16 from damage.

While there has been described above the principles of this invention in connection with a specific spool construction, it is to be understood that this description is made only by way of example and not as a limitation to the scope of the invention.

What is claimed is:

1. In a light weight plastic spool for the shipping, storage and handling of a substantial weight of a metal wire which comprises a tubular barrel portion, hub portions joined in opposite ends of the barrel portion, and outwardly flaring thin-wall end flange portions at opposite ends of the barrel portion, each of the end flange portions comprising a frustro-conical body of substantially uniform thickness and an enlarged peripheral rim portion at the outer larger end of the body with a circumferential outer end surface substantially tangent to a plane normal to the axis of the spool; the improvement wherein each of said hub portions comprises a cup-shaped body extending axially within a corresponding one of said end flange portions in radially spaced relation therewith; each said hub portion having a generally tubular load transfer side wall formed integrally at its inner end with said barrel portion and depending from said barrel portion in coaxial relation therewith; each said hub portion also having an end wall integral with and extending transversely across the outer end of a respective side wall thereof; each said side wall being structurally interconnected with said barrel portion and the respective one of said end walls in order to transfer the weight of a wire carried by the spool to said respective end wall; each of said end walls presenting an outer load bearing surface normal to the axis of the spool and lying outwardly of the plane of the outer end surface of said corresponding one end flange portion an appreciable distance to enable the weight of the wire carried by the spool to be transferred solely through a selected one of said hub portions to a supportive surface disposed below the spool for preventing impact of said one end flange portion with the supportive surface during shipment of the spool.

2. The invention of claim 1 wherein the end wall of each hub portion of the spool is provided with an axially inwardly extending cylindrical bushing formed integrally therewith at its center; each said hub portion having circumferentially spaced strengthening webs extending radially between said bushing and side wall thereof and integrally joined to said bushing, side wall and end wall thereof; each said side wall having circumferentially spaced strengthening ribs integrally joined thereto and extending longitudinally along the inner surface thereof to the inner surface of said barrel portion; said webs and ribs cooperating with said side walls to structurally reinforce said hub portions.

* * * * *